US008123982B2

(12) United States Patent
Ward et al.

(10) Patent No.: US 8,123,982 B2
(45) Date of Patent: Feb. 28, 2012

(54) SULFUR BASED CORROSION INHIBITORS

(75) Inventors: Eric C. Ward, Cookeville, TN (US); Alvie L. Foster, Jr., Chattanooga, TN (US); Michael L. Standish, Chattanooga, TN (US); Ivonne C. Weidner, Hixson, TN (US)

(73) Assignee: Akzo Nobel N.V., Arnhem (NL)

( * ) Notice: Subject to any disclaimer, the term of this patent is extended or adjusted under 35 U.S.C. 154(b) by 551 days.

(21) Appl. No.: 11/065,505

(22) Filed: Feb. 24, 2005

(65) Prior Publication Data

US 2005/0211957 A1 Sep. 29, 2005

Related U.S. Application Data

(60) Provisional application No. 60/556,851, filed on Mar. 26, 2004.

(51) Int. Cl.
*C23F 11/16* (2006.01)

(52) U.S. Cl. ..... 252/395; 558/235; 558/243

(58) Field of Classification Search ..... 252/387, 252/395

See application file for complete search history.

(56) References Cited

U.S. PATENT DOCUMENTS

| | | | | | |
|---|---|---|---|---|---|
| 2,574,576 | A | | 11/1951 | Marsh | |
| 2,945,781 | A | * | 7/1960 | Santmyer | 514/478 |
| 3,898,042 | A | * | 8/1975 | Webb et al. | 436/80 |
| 4,180,469 | A | | 12/1979 | Anderson | |
| 4,650,568 | A | * | 3/1987 | Kimble et al. | 209/167 |
| 4,826,625 | A | | 5/1989 | Thompson et al. | |
| 4,864,075 | A | | 9/1989 | Thompson et al. | |
| 5,089,227 | A | | 2/1992 | Thompson et al. | |
| 5,089,619 | A | | 2/1992 | Thompson et al. | |
| 5,128,065 | A | | 7/1992 | Hollander | |
| 5,244,600 | A | * | 9/1993 | Cuisia et al. | 252/396 |
| 5,407,597 | A | | 4/1995 | Busch | |
| 5,435,969 | A | * | 7/1995 | Hoots et al. | 422/14 |
| 5,512,212 | A | * | 4/1996 | Brown et al. | 252/387 |
| 5,549,832 | A | | 8/1996 | Ische et al. | |
| 5,654,198 | A | * | 8/1997 | Carrier et al. | 436/6 |
| 6,139,610 | A | | 10/2000 | Sinko | |
| 6,153,110 | A | * | 11/2000 | Richardson et al. | 210/739 |
| 2003/0213553 | A1 | | 11/2003 | Bernards et al. | |

FOREIGN PATENT DOCUMENTS

| | | | |
|---|---|---|---|
| FR | 1520287 | | 4/1968 |
| FR | 2174950 | | 10/1973 |
| JP | 55038913 | | 3/1980 |
| JP | 55038914 | | 3/1980 |
| JP | 59083780 | | 5/1984 |
| JP | 60217274 | | 10/1985 |
| JP | 63310931 A | * | 12/1988 |
| WO | WO03027215 | | 4/2003 |

OTHER PUBLICATIONS

Derwent English abstract of JP63310931A, 1998.* Rao, V.; P.; Rao, T.A. Sreenivasa; Ganorkar, M.C.; Dithiocarbamates as Corrossion . . . ; Bulletin of Electrochemistry, vol. 19(2-3); 1994, pp. 83-86.

Rao, V.; P.; Rao, T.A. Sreenivasa; Ganorkar, M.C.; Dithiocarbamates as Protective . . . ; Transactions of the Saest, vol. 26(4)); 1991, pp. 224-226.

Abd-El-Nabey, B.Al; El-Awady, A.A.; Aziz, S.G.; Structural Effects of . . . ; Corrosion Prevention and Control; vol. 38(3), 1991; pp. 68-74.

Patel, N.K.; Patel, L.N.; Patel, K.C.; Sodium Diethyldithiocarbamate . . . ; Chemical Era; vol. 11(1); 1975, pp. 17-20.

Shah, R.S.; Trivedi, A.M.; Sodium Diethyldithiocarbamate as . . . ; Werkstoffe and Korrosion—Materials and corrosion . . . ; vol. 25(7); 1974, pp. 521-523.

Desai, M.N.; Rana, S.S.; Inhibition of Copper . . . ; Werkstoffe and Korrosion—Materials and corrosion . . . ; vol. 17(10); 1966, pp. 870-875.

Kendig, M.W.; ; Mechanism of Corrossion Protection . . . ; International SAMPE Technical Conference vol. 33, 2001, pp. 938-947.

Desai, M.N.; Rana, S.S.; Inhibition of the Corrosion of Copper . . . ; Gujarat Univ., Ahmedabad, India; vol. 4(2), 1966; pp. 609-647.

Fan, H.B.; Fu, C.Y.; Wang, H.L., Guo, X.P., Zheng, J.S; Inhibition of Corrosion . . . ; British Corrosion Journal, vol. 37(2), 2002, pp. 122-125.

Fan, H; Wang, H; Guo, X; Zheng, F; Corrosion Inhibition Mechanism . . . Anti-Corrosion Methods Materials, vol. 49(4): 2002; pp. 270-276.

Cao, M; Fan, H; Qi, G; Zheng, J; Investigation of the Protection . . . ; Journal-Jiangsu Institute of petrochemical Technology; vol. 14(4) 2002; pp. 36-38.

Fah, H; Grey Relational Analysis; Journal-Jiangsu Institute of petrochemical Technology; vol. 14(2) 2002; pp. 30-32.

Aljinovic, L.J.; Gudic, S; Smith, M.; Inhibition of CunNi10Fe . . . ; Journal of Applied Electrochemistry; vol. 30(8) 2000; pp. 973-979.

Smith, M; Gudic, S; Gotovac, V; Aljinovic, L.J.; Efficiency of Inhibition . . . ; Ann. Univ. Ferrara, Sez. 5 suppl (9th Europe Symp Corrosion Inhibitors; vol. 1, 2000, pp. 651-660.

Singh, M.M.; Rastogi, R.B.; Upadhyay, B.N.; Yadav, M.; Corrosion Inhibition of . . . ; Indian Journal of Chemical Technology; vol. 6(2),1999, pp. 93-99.

Mathiyarau, J; Palaniswamy, N; Subramanian, P; Rengaswamy, N.S.; Inhibition of Corrosion . . . ; Bulletin of Electrochemistry, vol. 14(4-5); 1998; pp. 145-150.

Singh, M.M.; Rastogi, R.B.; Upadhyay, B.N.; Inhibition of Copper . . . ; Bulletin of Electrochemistry, vol. 12(1-2); 1996; pp. 26-30.

Latha, G; Rajeswari, S; Diethyldithiocarbamate as a Corrosion . . . ; Anti-Corrosion Methods Materials, vol. 43(1), 1996, pp. 13-16.

Abdulhay, M.A.; Al-Suhybani, A.A.; Study of Dithiocarbamtes . . . ; Indian Journal of Chemical Technology; vol. 2(1) 1995; pp. 25-31.

Pandit Rao V. et al., "Dithiocarbamates as Corrosion Inhibitors for Copper," vol. 47, No. 10, Oct. 1, 1996; p. R122-R126.

European Office Action; Application No. 0500522.4; Mail Date: Jun. 22, 2009.

European Office Action; Application No. 0500522.4; Mail Date: Jul. 31, 2006.

Chinese Office Action; Application No. 200510062757.4; Mail Date: Jul. 10, 2009.

Chinese Office Action; Application No. 200510062757.4; Mail Date: Oct. 17, 2008.

* cited by examiner

*Primary Examiner* — Peter F Godenschwager

(74) *Attorney, Agent, or Firm* — Norris McLaughlin & Marcus, P.A.

(57) ABSTRACT

Alternative inhibitors that offer an improvement over tolyltriazole in inhibiting yellow metal corrosion. The dithiocarbamate compounds and their salts were compared to that of tolyltriazole under identical conditions. These comparative tests were conducted in common corrosion testing systems, using both electrochemical corrosion cells and pilot cooling rigs, using various water conditions. The test methods included electrochemical studies such as linear polarization resistance, open circuit potential versus time, Tafel and cyclic polarization.

26 Claims, 16 Drawing Sheets

Figure 1. Molecular Modeling Study - Potential Copper Binding Sites
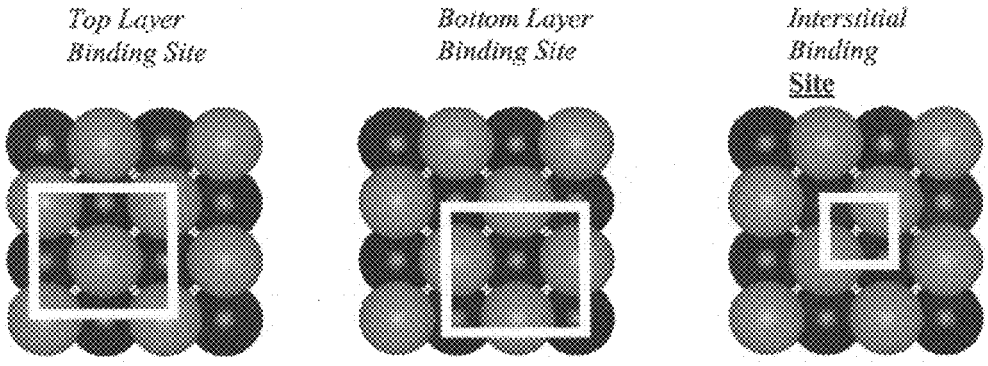

Figure 2. Molecular Modeling Study – Molecular Configuration Types
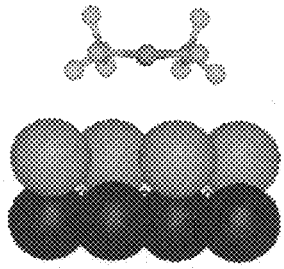
*Flat -parallel to surface*
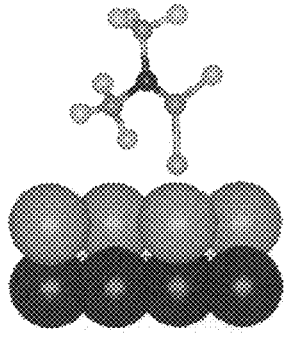
*S - skewed perpendicular to surface*
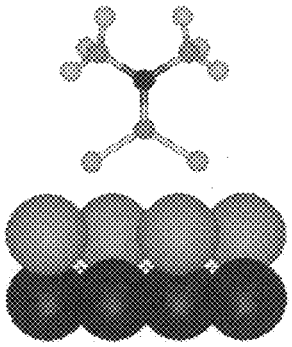
Up (CCI) - *perpendicular to surface*
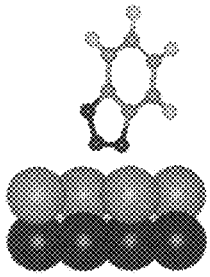
Up (BTA) - *perpendicular to surface*

Figure 3. Residual Inhibitor Corrosion Rates versus Time
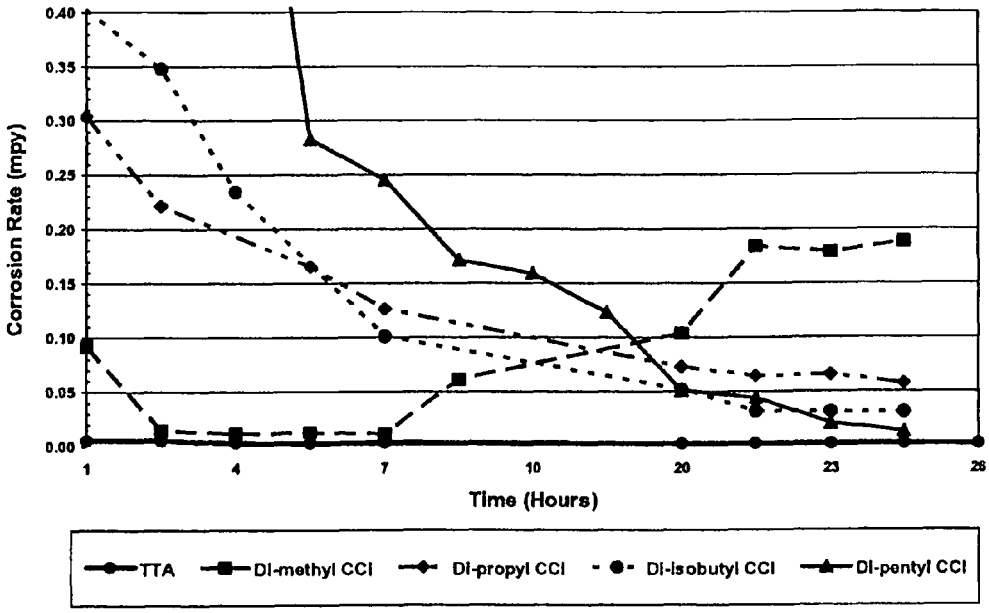

Figure 4. Tafel Comparison of Active Di-benzyl CCI Dosages on admiralty brass electrodes
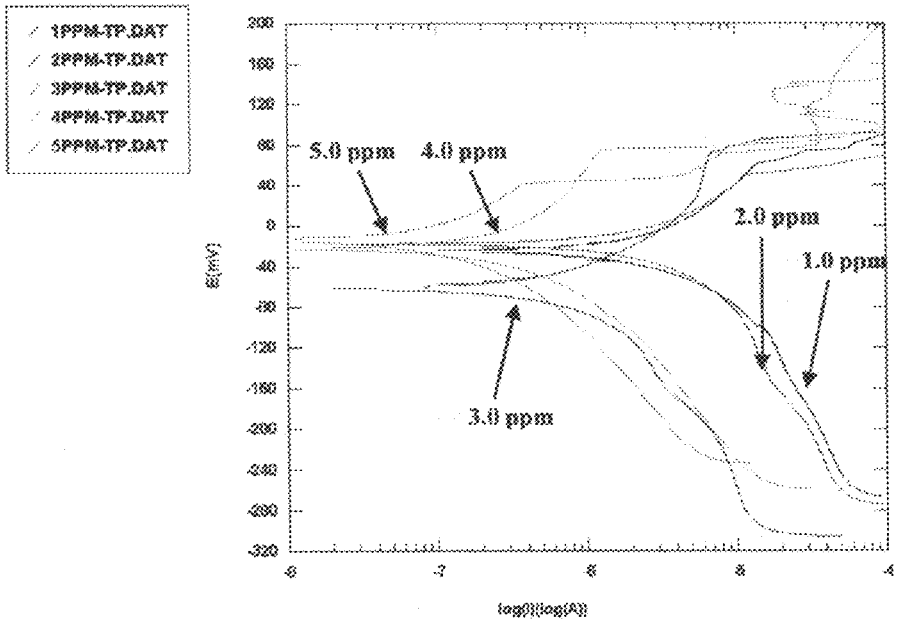

Figure 5. Photograph of the admiralty brass electrodes used for the Tafel Comparison of Active Dibenzyl CCI Dosages in Figure 4
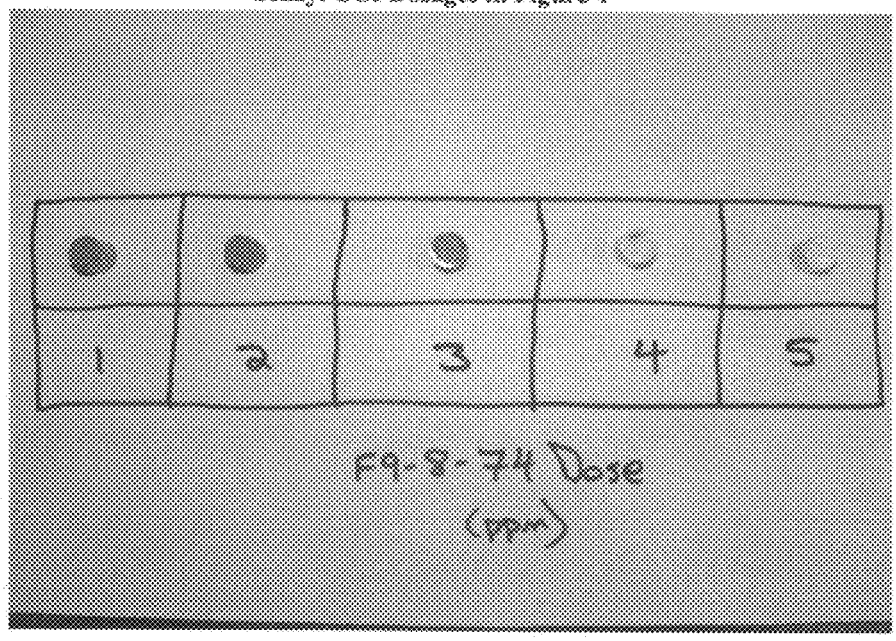

*Figure 6.* Tafel Plots of Inhibitors without Residual Inhibitor
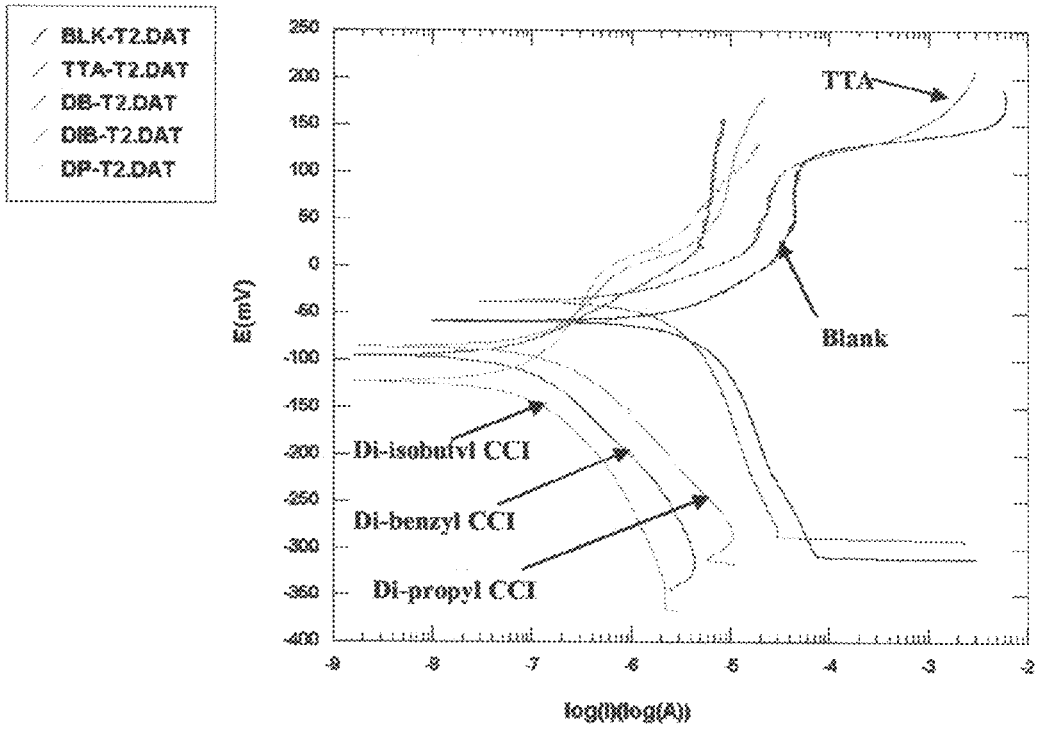

Figure 7. Overlaid Cyclic Polarization Graphs of Di-Benzyl CCI, BTA and TTA with Residual, and a Blank
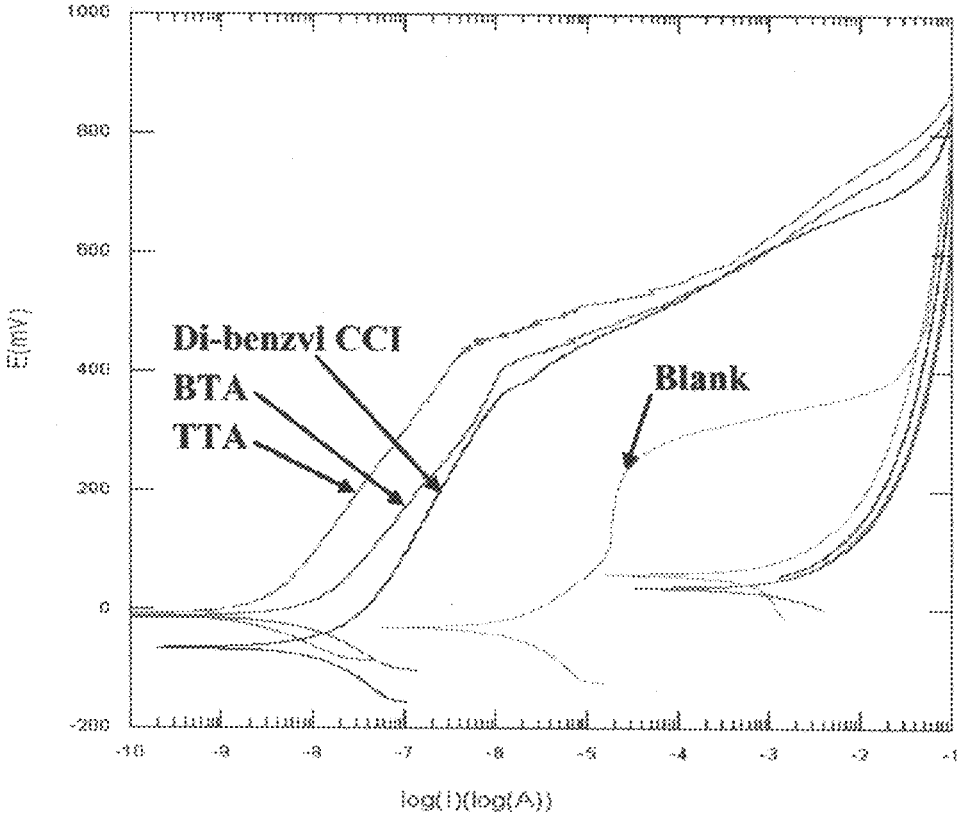

Figure 8. Overlaid Cyclic Polarization Graphs of Di-Benzyl CCI, BTA and TTA without Residual, and a Blank
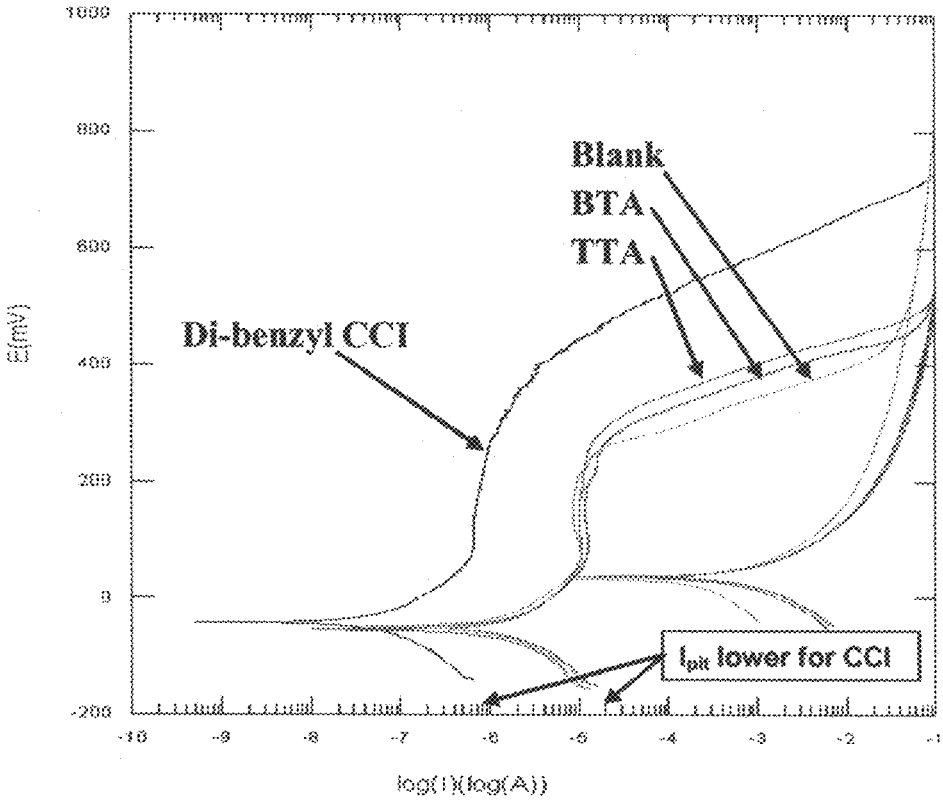

Figure 9. Corrosion Rates of Di-Benzyl CCI and TTA without Residual in the Presence of Low levels of Hypochlorite.
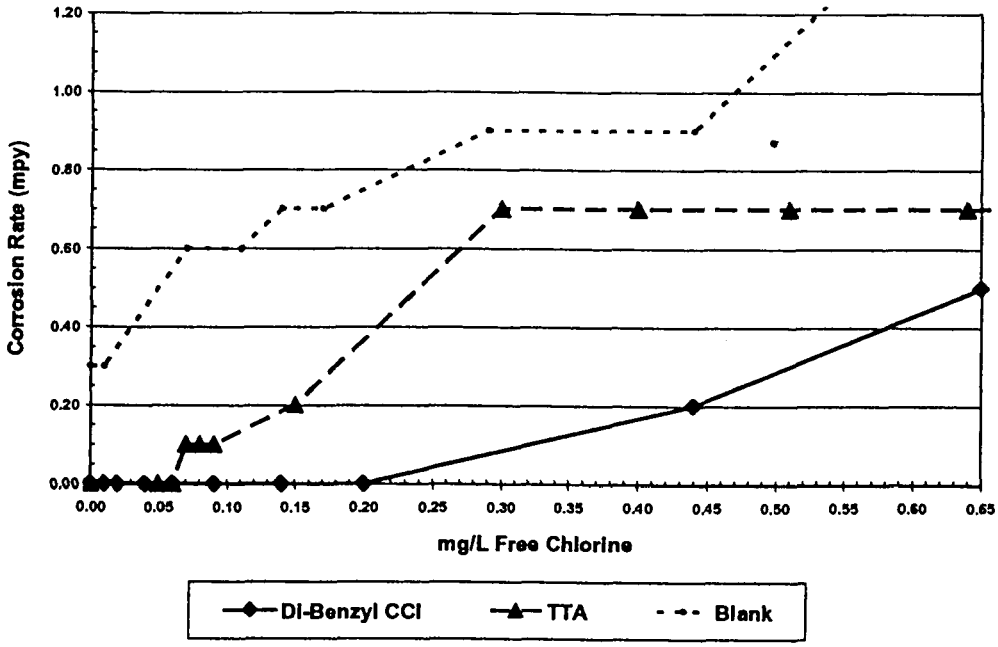

Figure 10. Tafel Extrapolated Corrosion Rates of Di-Benzyl CCI and TTA in the Presence of Low levels of Hypochlorite and no Residual Inhibitor
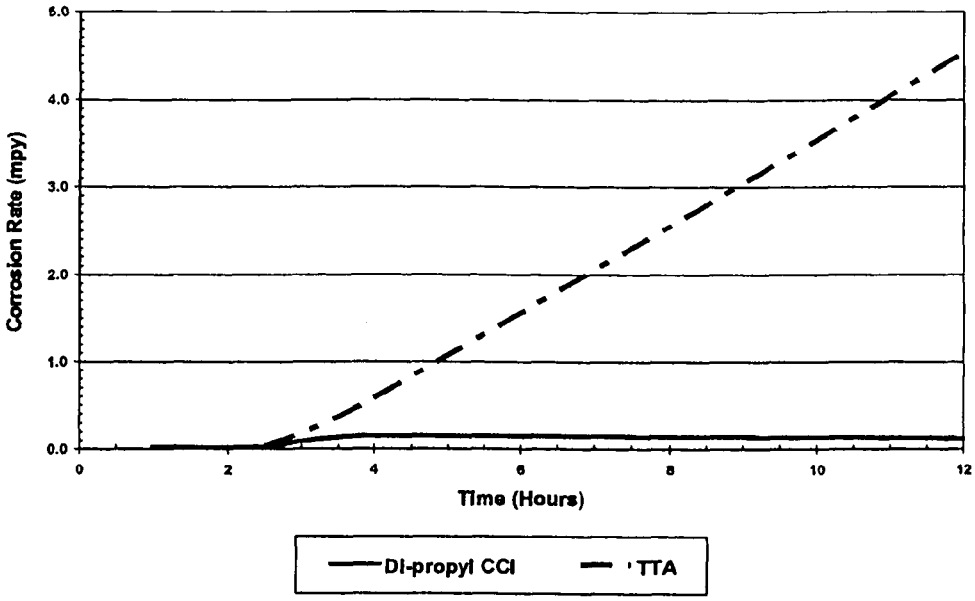

Figure 11. Microscopic Photographs of the Copper Electrodes After the Tafel Polarization Measurements from Figure 11.
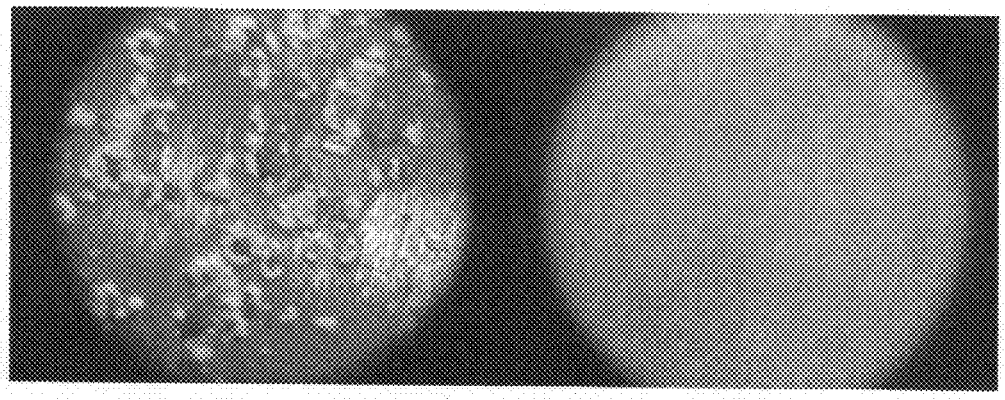
TTA
Di-Benzyl CCI Figure 12. Free Chlorine Concentrations throughout Long Term Pilot Testing
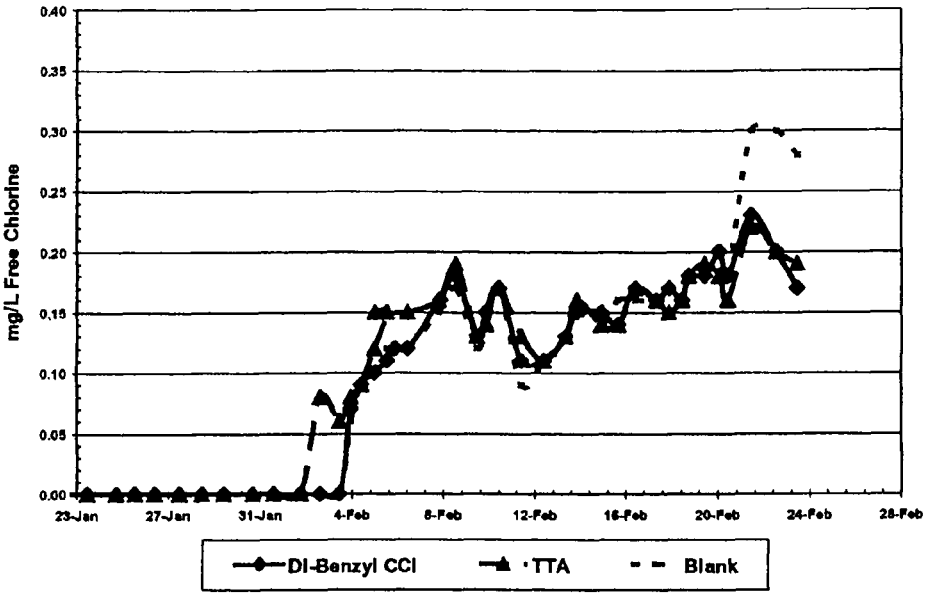

Figure 13. General Corrosion Rates throughout Long Term Pilot Testing
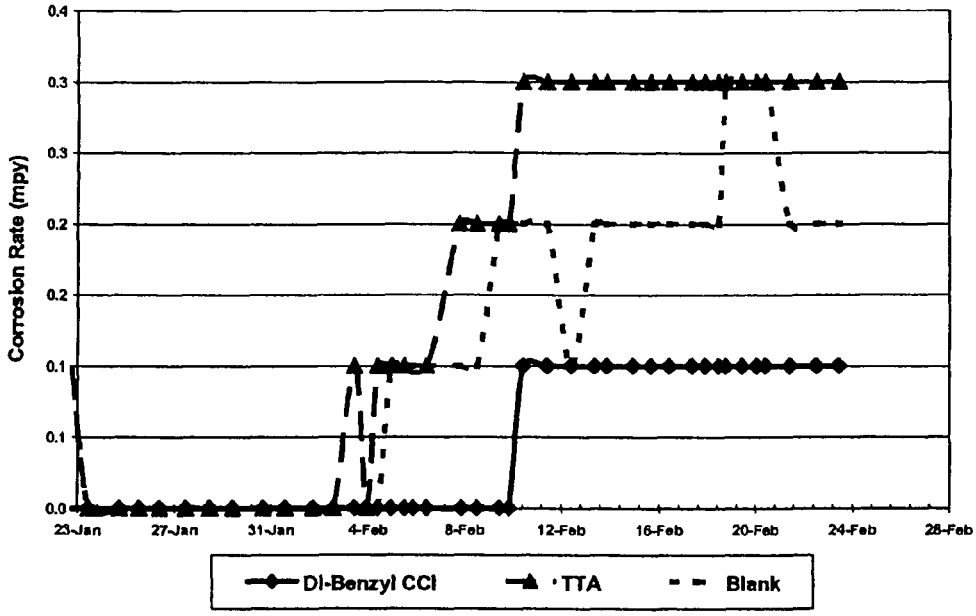

Figure 14. Soluble Copper Concentrations throughout Long Term Pilot Testing
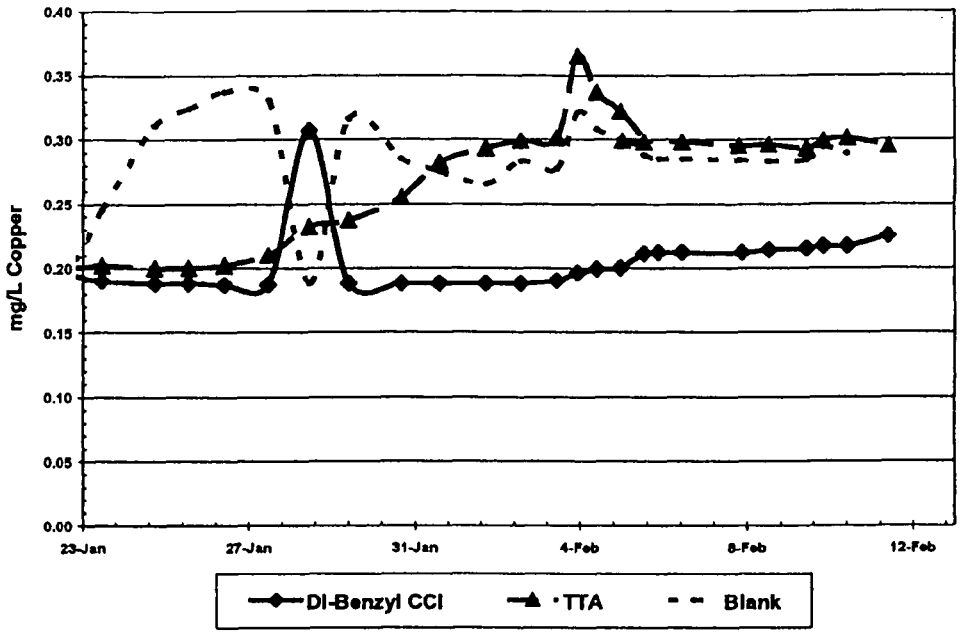

Figure 15. Copper CDA-122 Heat Exchange Tube after Long Term Pilot Testing
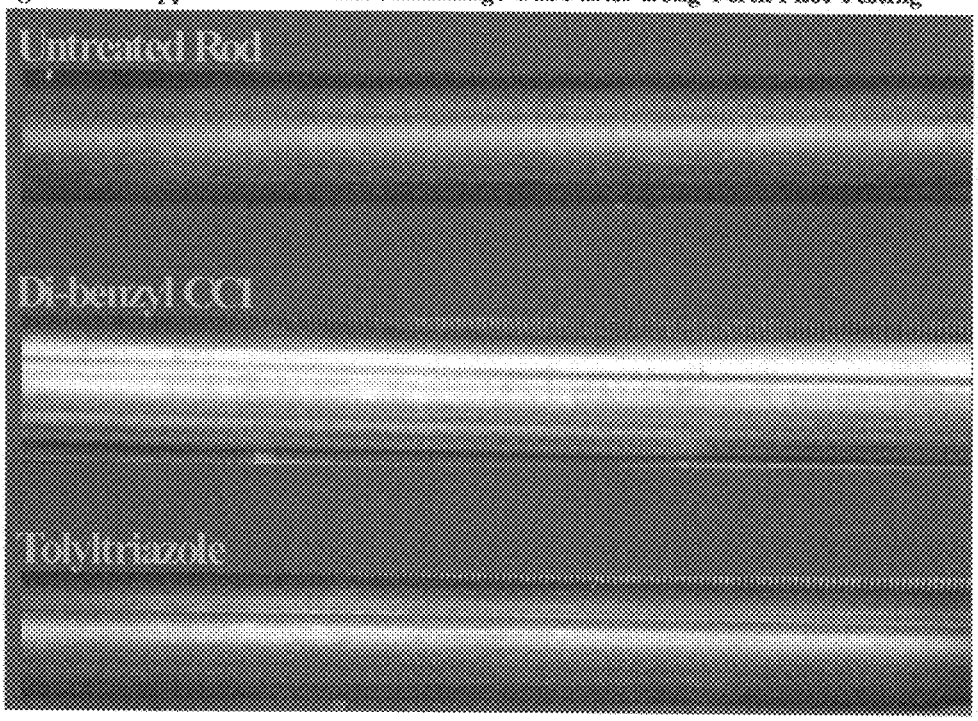

Figure 16. General Mild Steel Corrosion Rates during Testing
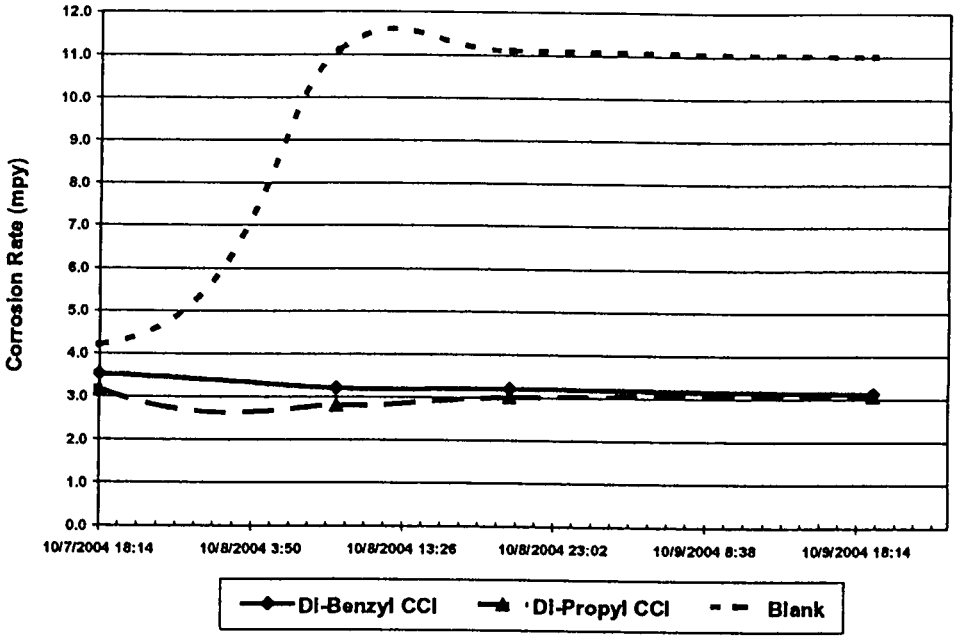

SULFUR BASED CORROSION INHIBITORS

CROSS REFERENCE TO RELATED APPLICATIONS

The present application claims the benefit of U.S. Provisional Application No. 60/556,851, filed 26 Mar. 2004.

BACKGROUND OF THE INVENTION

1. Technical Field

The present invention is directed towards corrosion inhibitors. More specifically, the present invention is directed towards sulfur based corrosion inhibitors for use in metal corrosion inhibition, particularly yellow metal.

2. Background Information

Copper corrosion inhibitors are widely considered a staple ingredient in most water treatment formulations. These inhibitors are designed to protect against the corrosion of the copper alloy surfaces found within industrial cooling systems, especially at the heat exchange surface. The accelerated corrosion of these surfaces and resulting galvanic deposition of copper onto existing ferrous metal surfaces can have detrimental effects on the structural integrity and operation of the cooling system. As a result, copper corrosion inhibitors have always been a staple ingredient in most water treatment formulations.

For at least the last thirty years, benzotriazole ('BTA') and its derivatives have dominated industrial yellow metal corrosion inhibitors. Its derivatives include tolyltriazole ('TTA') and 2-mercapto benzotriazole ('MBT'). Their structures are illustrated as follows

BTA

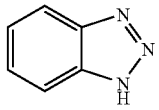

TTA

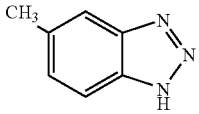

MBT

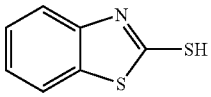

By far, the most popular of these has been 4-5 methyl benzotriazole, or TTA. It has become the industry standard and is usually the only copper corrosion inhibitor considered by water treatment experts. Triazole inhibitors are typically dosed into cooling towers at a range of 2.0 to 5.0 mg/L. In closed loop recirculating systems, their dosages can reach as high as 25 to 50 mg/L.

Even though they dominate all other competitors, triazoles' dominance, including TTA, still have their weaknesses in certain applications. For example, tests have shown that chlorine added as a biocide can penetrate the thin tolyltriazole film causing accelerated corrosion rates. The tenacious, hydrophobic film formed with tolyltriazole makes it very resistant to breakdown in aqueous environments. However, because of the film's thinness, it is not very forgiving if breakdown does occur. At elevated levels, both chlorine and bromine have been found to attack and breakdown the formed film, causing corrosion inhibition failure. Therefore, a user must assure that there is residual inhibitor present in these situations to repair the damage.

Both BTA and TTA are believed to utilize the triazole functional group as their binding site to the metal, resulting in a protective film on the copper surface. Spectroscopic analyses have shown that the film formed is a 1:1 molar complex of Cu(I) and triazole. This complex is thought to stabilize Cu(I), preventing the copper from oxidizing further, thereby preventing the anodic reactions. The retardation of the cathodic reaction is believed to be accomplished by the hydrophobic backbone of the formed film, which inhibits the transport of hydrated, electronically active species to the metal surface. However, the properties of these two films are quite different. The film formed by TTA has been found to be more resistant to breakdown in aqueous environments. The methyl group on the TTA molecule is believed to sterically hinder the film's thickness, as well as offer more hydrophobicity. Both of these properties contribute to its greater resistance. However, as noted above, TTA's thin film is not as forgiving as BTA should breakdown occurs. In contrast to TTA, the BTA film is much thicker, consisting of many layers. Although it is more easily penetrated than the TTA film, its extra thickness helps act as a buffer against complete breakdown.

One of the most frequently claimed weakness of triazoles has been their susceptibility to degradation from oxidizing, halogenated biocides. This degradation is believed to affect both the formed triazole film and the residual inhibitor in solution, which has the potential to consume all of the added biocide. Most studies have indicated that free triazole, in solution, is susceptible to degradation in the presence of halogenated biocides. However, studies have differed on the degree of this degradation, ranging from severe and detrimental to mild and insignificant. There is even greater debate over the effect halogenated biocides may have on previously formed triazole films.

Some studies have proposed that the film is not damaged at all, but simply penetrated by chlorine. This attack is more pronounced immediately after chlorine addition, when chlorine concentrations are at their highest. Once the chlorine concentration falls, the corrosion rates fall back to baseline values. The more hydrophobic TTA film is more resistant to this type of low level attack than BTA, requiring more free chlorine to initiate attack. This penetration attack has been found with short term dosages of less than 1.0 ppm chlorine. Longer exposure times and higher concentrations have been found to damage the film in situations where no residual inhibitor is present. The hydrophobicity of the film does not seem to offer any added benefit against this type of attack. In contrast, bromine has been found to be much less aggressive to the metal because its larger sized atom cannot penetrate the TTA film.

To overcome triazoles' weaknesses, most water treatment experts recommend keeping a residual amount of inhibitor present in the water to repair any damaged areas of the film. It has become common practice in most traditional cooling water treatment programs to always maintain a constant residual level of triazole in the cooling water of around 2.5 mg/L active product. It is also advised to use a scheduled intermittent feed of inhibitor that occurs just prior to and also during any halogen addition. However, the most common reason for keeping a residual in the water, whether in combination with halogenated biocides or not, is to offer an additional level of security in case of film breakdown.

More recent tests have demonstrated that this need to maintain a residual amount of inhibitor such as azole may be more critical than previously suggested. These tests found that both BTA and TTA films are surprisingly weak, even when not in the presence of oxidizing biocides, breaking down immediately when no residual inhibitor is present. The need to maintain a residual amount of triazole in the cooling water is critical to the triazoles' success at corrosion inhibition. Without the residual inhibitor, the films offer very little sustained protection from corrosion. These findings demonstrate that the success of the azoles' corrosion protection relies solely on the immediate repair of damaged film by free inhibitor in the water, not in the formation of a tenacious, hydrophobic film. Still, there is room for improvement.

Various attempts have been made to develop viable alternatives to TTA in the last few years. These compounds have consisted primarily of triazole derivatives having more hydrophobic backbones that offer better resistance to halogenated biocide degradation. These past studies have focused on the degradation of the residual inhibitor in solution with very little discussion of the film's susceptibility itself.

Accordingly, there is a need for an alternative yellow metal corrosion inhibitor that overcomes the film susceptibility of triazoles, particularly with respect to chlorine. Further, there is a need for an alternative yellow metal corrosion inhibitor that provides improved resistance to degradation by biocides.

SUMMARY OF THE INVENTION

The present invention provides alternative inhibitors that offer an improvement over tolyltriazole in a number of areas. In particular, the present invention is directed towards sulfur based corrosion inhibitors that associate with metals, particularly copper, strongly enough to form a protective barrier or film. Further, the inhibitors of the present invention are able to maintain corrosion protection over an extended period of time, e.g., for several weeks, without the presence of any inhibitor in solution. Examples of such inhibitors include dithiocarbamate acids and their salts.

The corrosion inhibitors of the present invention provide improved film durability over commercially available inhibitors such as the triazoles. Films formed from the corrosion inhibitors of the present invention provide superior resistance to low level halogenation as compared to commercial inhibitors. The inhibitors of the present invention have the added benefit in that the use of residual inhibitors becomes optional. Additionally, the inhibitors of the present invention provide corrosion protection for a variety of copper alloys, as well as the additional protection of mild steel surfaces.

The corrosion inhibitors of the present invention offer as its primary binding site to the metal a different functional moiety, or 'hook', from the common triazole functional group. Further, it has been learned that varying the compound's aliphatic or aromatic substituents has a significant impact on the performance of the inhibitors' filming abilities. By optimizing the balance between the hydrophobicity and steric properties of these substituent 'shields', an improved corrosion inhibitor is provided.

In one aspect, the present invention uses structurally enhanced dithiocarbamate salts or mixtures of such salts for efficiently inhibiting the corrosion of copper and its alloys under a wide range of aqueous conditions encountered in the water treatment industry. The salts are illustrated herein due to the inherent instability of the acids. However, it should be understood that these species can exist in either their basic or acidic form for application.

The sulfur based corrosion inhibitors of the present invention provide at least equal and sustained corrosion protection when compared to industry standards. Further, the copper corrosion inhibitors of the present invention can be more easily formulated over a wide range of conditions. The copper corrosion inhibitors of the present invention can provide resistance to common oxidants found in water treatment formulations.

The present invention includes compounds or molecules having the following general structure—

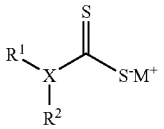

wherein $M^+$ represents an alkali or alkaline earth metal cation such as $Na^+$ or $Ca^{++}$. X can be either nitrogen ('N') or sulfur ('S').

If X is sulfur (e.g., a trithiocarbonate), then $R^2$ does not exist and $R^1$ can be H, $C_1$-$C_{12}$ alkyl, aryl or polyaryl, $C_1$-$C_{12}$ alkaryl, $C_1$-$C_{12}$ cycloalkly, $C_1$-$C_{12}$ alkoxy, $C_1$-$C_{12}$ polyalkoxy, hydroxyl or polyhydroxy, $C_1$-$C_{12}$ alkylcarboxy, $C_1$-$C_{12}$ alkylamino, $C_1$-$C_{12}$ haloalkyl, haloaryl, alkoxyaryl, hydroxyaryl, aminoaryl, carboxyaryl, and combinations or further functionalized variants of the above.

If X is nitrogen (e.g., a dithiocarbamate or a dithio compound), then $R^1$ can be H, $C_1$-$C_{12}$ alkyl, aryl or polyaryl, $C_1$-$C_{12}$ alkaryl, $C_1$-$C_{12}$ cycloalkly, $C_1$-$C_{12}$ alkoxy, $C_1$-$C_{12}$ polyalkoxy, hydroxyl or polyhydroxy, $C_1$-$C_{12}$ alkylcarboxy, $C_1$-$C_{12}$ alkylamino, $C_1$-$C_{12}$ haloalkyl, haloaryl, alkoxyaryl, hydroxyaryl, aminoaryl, carboxyaryl, or combinations or further functionalized variants of the above; and $R_2$ can be H, $C_1$-$C_{12}$ alkyl, aryl or polyaryl, $C_1$-$C_{12}$ alkaryl, $C_1$-$C_{12}$ cycloalkly, $C_1$-$C_{12}$ alkoxy, $C_1$-$C_{12}$ polyalkoxy, hydroxyl or polyhydroxy, $C_1$-$C_{12}$ alkylcarboxy, $C_1$-$C_{12}$ alkylamino, $C_1$-$C_{12}$ haloalkyl, haloaryl, alkoxyaryl, hydroxyaryl, aminoaryl, carboxyaryl, or combinations or further functionalized variants of the above. $R^1$ and $R^2$ can be different or equivalent substituents within the same molecule.

Further, if X is nitrogen, then the invention can include multiple repeating units called functionalized multi-amines or functionalized polyamines. The functionalities would consist of dithiocarbamate groups, $R^1$ substituents, and $R^2$ substituents as defined above.

In one aspect, the present invention is an aqueous solution having one or more sulfur based corrosion inhibitors. In another aspect, the sulfur based corrosion inhibitors of the present invention are one or more dithiocarbamate salts. In another aspect, the present invention is an aqueous solution having one or more dithiocarbamate salts with the solution being about 10% to about 50% active. In one aspect, the present invention is an aqueous solution having one or more dithiocarbamate salts with the solution having a pH that stabilizes the one or more dithiocarbamate salts. In another aspect, the solution has a pH of at least about 10 or greater for stabilizing the one or more dithiocarbamate salts. In even another aspect, the present invention is an aqueous solution having one or more dithiocarbamate salts with the solution having a pH of about 11 to about 13 for stabilizing the one or more dithiocarbamate salts. In another aspect, the aqueous solution further includes an organic co-solvent for maintaining one or more dithiocarbamate salts in solution. In another aspect, the organic co-solvent is isopropyl alcohol. In one aspect, the organic co-solvent also includes 10% diethyl hydroxylamine, added for stability of the product.

In another embodiment the yellow metal corrosion inhibitors of the present invention are further useful in inhibiting mild steel corrosion. 'Mild' steel is understood to refer to carbon and low alloy steels. In one embodiment the yellow metal corrosion inhibitors of the present invention are further useful in inhibiting metal alloy corrosion. Such metal alloys include, e.g., galvanized steel, stainless steel, cast iron, nickel and combinations thereof.

The present invention is also directed towards a method of inhibiting yellow metal corrosion wherein an effective amount of one or more of the above described compounds or molecules is added to an aqueous system such as a cooling water tower. For example, the aqueous system can be dosed with about 0.1 mg/L to about 100 mg/L of the above described compounds or molecules. In one embodiment, the aqueous system is dosed with about 4.0 mg/L to about 5.0 mg/L of one or more of the above described compounds or molecules.

In another embodiment, the present invention is directed towards a method of inhibiting yellow metal corrosion wherein an effective amount of one or more of the above described compounds or molecules is added or coated directly to the metal surface and rinsed, such as dipping the metal into the inhibitor, spraying or painting the inhibitor onto the metal surface and so forth. In this respect, the method further includes coating a metal surface with a formulation or product formed from one or more active inhibitors and at least one co-solvent in an amount effective for maintaining the solubility of the active inhibitor(s).

As discussed above, azoles require maintaining residual inhibitor in aqueous systems for repairing damage to the azole film. In contrast, the inhibitor of the present invention does not require the presence of a residual inhibitor to prevent corrosion. Accordingly, the durability of films formed from the present inhibitor allows a user to completely alter the method of treating the aqueous system. This method includes slug-dosing the inhibitor of the present invention into the aqueous system without a constant feed of inhibitor to maintain a residual level in the water. Such a method of treatment can offer several advantages to the end user, including reduced costs, less monitoring, and so forth. Further, this type of treatment cannot be conducted successfully by azoles, as azoles require the addition of the residual inhibitor.

As the above described compounds or molecules of the present invention are strong reducing agents, one skilled in the art would recognize that compositions are detectable by oxidation/reduction potential (ORP) monitoring. The compositions cause a significant drop in ORP readings when added to the system. Further, at least one of the molecules has ORP readings that drop like other molecules, but then rise quickly back to the initial reading prior to treatment. This indicates interaction of the molecule with the metal surface and formation of the film. This behavior offers a unique way of knowing when enough inhibitor is added to protect the metal surface that is valuable to the end user.

Further, at least one of the compounds or molecules is able to be detected in cooling water by UV absorption. It is believed that this is due to an aromatic group in the molecule, which is not present in all of the molecules described above. Dibenzyl dithiocarbamate is an example of such a compound. However, any of the compounds described above having aromatic substituents should be detectable by UV absorption.

Accordingly, the present invention provides a method of treating an aqueous system wherein at least one of the compounds or molecules of the present invention is detected, measured, and dosage controlled utilizing UV spectroscopy and/or oxidation-reduction potential measurement. The method further includes utilizing UV spectroscopy to detect, measure, and control dosage of other additives such as polymers containing aromatic monomers.

The sulfur based copper corrosion inhibitors (CCIs) of the present invention include both aliphatic and aromatic substituents combined with a common functional moiety. The present invention shows that variations on CCIs' hydrophobic substituents have significant impact on the performance of the inhibitor's filming abilities.

The sulfur-based CCIs substituents tested included those with di-methyl, di-ethyl, di-propyl, di-isopropyl, di-butyl, di-isobutyl, di-pentyl, and di-benzyl groups. Each molecule's performances were compared to that of tolyltriazole under identical conditions in common corrosion testing systems, using both electrochemical corrosion cells and pilot cooling rigs, with various water conditions. The electrochemical studies included linear polarization resistance, open circuit potential versus time, Tafel and cyclic polarization.

BRIEF DESCRIPTION OF THE DRAWINGS

FIG. 1 illustrates three potential binding sites to a two-layered copper atom cluster of sixteen (16) atoms.

FIG. 2 illustrates three angles of approach or configuration types of compounds according to the present invention for binding with the two-layered copper atom cluster of FIG. 1.

FIG. 3 is a graph illustrating the time required for a variety of residual inhibitors to reach their optimum performance in controlling copper corrosion.

FIG. 4 is a Tafel plot illustrating an improvement in the suppression of corrosion reactions of admiralty brass electrodes with increasing doses (one to five ppm) of di-benzyl CCI.

FIG. 5 is a photograph illustrating an increasing improvement in corrosion inhibition of the admiralty brass electrodes tested in the Tafel polarizations of FIG. 4.

FIG. 6 is a Tafel plot comparing the effect of various active inhibitors in inhibiting the corrosion rate of copper when provided in 5.0 mg/L doses without any residual inhibitor.

FIG. 7 is a cyclic polarization graph comparing the effect of a di-benzyl CCI according to the present invention against BTA and TTA with 5.0 mg/L dose of residual inhibitor.

FIG. 8 is a cyclic polarization graph comparing the effect of a di-isobutyl CCI according to the present invention against BTA and TTA without the presence of residual inhibitor.

FIG. 9 is a graph comparing the ability of di-benzyl CCI according to the present invention versus TTA to inhibit corrosion without residual inhibitor in the presence of low levels of hypochlorite.

FIG. 10 is a graph comparing Tafel extrapolated corrosion rates over time of di-benzyl CCI according to the present invention and TTA in the presence of low levels of hypochlorite without residual inhibitor.

FIG. 11 is two photographs of copper electrodes used in plotting the graph of FIG. 11, one treated with di-benzyl CCI according to the present invention and the other treated with TTA, showing the corrosion effect over time.

FIG. 12 is a graph illustrating free chlorine concentrations over time during long-term pilot testing of one pilot system treated with di-benzyl CCI according to the present invention, one pilot system treated with TTA and one pilot system untreated.

FIG. 13 is a graph illustrating copper corrosion rates over time during long-term pilot testing of one pilot system treated with di-benzyl CCI according to the present invention, one pilot system treated with TTA without residual inhibitor and one pilot system untreated.

FIG. 14 is a graph illustrating soluble copper concentrations over time during long-term pilot testing of one pilot system treated with di-benzyl CCI according to the present invention, one pilot system treated with TTA without residual inhibitor and one pilot system untreated.

FIG. 15 is a photograph illustrating the differences between copper heat exchange tubes used in pilot testing systems treated over time; wherein one pilot system was treated with di-benzyl CCI according to the present invention, one pilot system was treated with TTA without residual inhibitor and one pilot system was untreated.

FIG. 16 is a graph illustrating mild steel corrosion rates over time during long-term pilot testing of one pilot system treated with di-benzyl CCI according to the present invention, one pilot system treated with di-propyl CCI according to the present invention, and one pilot system untreated.

DETAILED DESCRIPTION OF THE INVENTION

The present invention is directed towards sulfur based compounds that associate with metals such as copper strongly enough to form a noticeable barrier. Both aliphatic and aromatic molecules having the general structure described above were evaluated for their copper corrosion inhibitive properties. These included, for example, sodium dimethyl dithiocarbamate ('SDDC'), di-sodium trithiocarbonate ('TTC'), ethylene bis-dithiocarbamate ('EBDC') and sodium di-ethyl dithiocarbamate ('SDEDC'), illustrated as—

SDDC

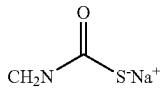

TTC

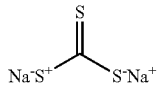

EBDC

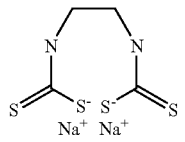

SDEDC

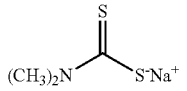

Other examples included polymeric dithio compounds such as—

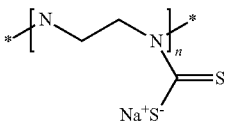

and alkyl trithiocarbonates such as—

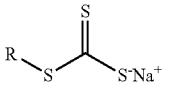

The compounds' performances were compared to that of TTA under identical conditions. These comparative tests were conducted in common corrosion testing systems, using both electrochemical corrosion cells and pilot cooling rigs, using various water conditions. The test methods included electrochemical studies, such as linear polarization resistance, open circuit potential versus time, Tafel and cyclic polarization.

EXPERIMENTAL PROCEDURE

Electrochemical Testing Overview—

Electrochemical testing provides a method for determining the corrosion rate of a metal before any weight loss can be detected. For copper, where corrosion rates are usually less than 2.0 mils per year ('mpy'), electrochemical testing is even more valuable since weight loss would take significant time to detect. When evaluating corrosion inhibitors, this feature allows for quick assessment of inhibitor performance, including general corrosion rate and film durability. The tests are performed by applying a potential to an electrode in an electrolyte and measuring the electrical current produced. When the current is divided by electrode surface area ('Amps/cm$^2$'), it can be easily converted to a standard corrosion rate in mpy.

A measured electrode potential taken in the absence of an applied potential is referred to as the open circuit potential ('OCP'). The degree of potential applied to an electrode is always centered around the OCP and is referred to as the overpotential, whether it is a decrease or increase in potential from OCP. When an overpotential is applied that is >50 mV from OCP, the cathodic current becomes minute and the electrode essentially becomes an anode. When an overpotential is applied that is <50 mV from OCP, the electrode becomes a cathode. The ability to independently control each half reaction allows for the measurement of the external currents they produce. The larger this overpotential is, the more information that can be obtained about the corrosion of the metal in question. Lower overpotential ranges up to 500 mV can provide information about general corrosion, while overpotential ranges of 1000 mV to 2250 mV can provide information about pitting and/or crevice corrosion.

Linear Polarization Resistance. Linear polarizations provide quick estimations of general corrosion rates. Because of their small overpotential range of −20 mV to +20 mV from OCP, the test method does not damage the metal surface. This allows for unlimited monitoring of corrosion rates within a system over time. As a result, this method is most useful as a screening method in the corrosion cells and as the primary corrosion monitor in longer term pilot tests where non-destructive test are required.

Tafel Polarizations. Tafel polarizations provide the most detailed information on general corrosion. The cathodic and anodic branches are generated by applying a potential that is approximately −250 mV from OCP and then increased stepwise until the potential is approximately +250 mV from OCP. The potential-current data are plotted as applied potential versus log values of current density. The corrosion rates are determined from Tafel plots by extrapolating lines from where the anodic and cathodic branches become linear to where they would intersect at OCP. Tafel extrapolation is a means of estimating the actual corrosion rate of the metal, at its open circuit potential. This corrosion rate cannot be measured directly because the non-polarized metal will measure a current density of zero even though metal may be being lost. The point on the x-axis at which this intersection occurs gives the current density ($i_{corr}$) for the metal in question. This current density can then be converted into a corrosion rate in mils per year.

In addition to general corrosion rates, the Tafel method can provide information on the mechanistic inhibition properties of inhibitors by observing the slopes of the cathodic and anodic lines along with the overall suppressions. Increased slopes indicate that the current density undergoes less change per overpotential dosage. The ability to resist this change is an indication of the effectiveness of the inhibitor to impede corrosion as conditions worsen. Overall suppression is defined as an overall shift to smaller current densities in the anodic and cathodic lines. When plotted with the potential on the y-axis and current density on the x-axis, this means a shift to the left, along the x-axis.

Cyclic Polarizations. Cyclic Polarizations provide the most information about the properties of an inhibitive film. The cathodic and anodic branches are generated by applying a potential that is approximately −250 mV from OCP and then increased, step wise, until the potential is approximately +1000 mV from OCP or current density reaches a pre-set magnitude. At this point, the potential is reversed and decreased back to a current density of zero. Key points on a cyclic polarization curve are the primary passivation potential ($E_{pp}$), breakdown potential ($E_{bd}$), and re-passivation potential ($E_{rp}$). Through the location of these key points on the graph, detailed information can be gained about the film's durability, reparability, and pitting tendency.

Corrosion Cell Testing—

All Tafel and cyclic polarizations were performed in 1 L corrosion flasks. Each flask was filled with electrolyte test water and immersed in a stirring water bath at a temperature of 50° C. All testing was performed using CDA110 or CDA 122 copper working electrodes, graphite counter electrodes, and Ag/AgCl reference electrodes. Working electrodes were rinsed in acetone and DI water prior to immersion into the test water and then allowed to sit undisturbed until a stable OCP was obtained (usually 30 to 60 minutes). At this time, a 5.0 mg/L active dose of the inhibitor was added to the electrolyte test water. Two different test waters were used, depending on the stage of testing. Electrochemical measurements were made using a Model 263A Potentiostat/Galvanostat (available from Princeton Applied Research, Oak Ridge, Tenn.).

Primary Screening Water. This water contained 1000 mg/L NaCl and 1000 mg/L M Alkalinity. The pH of the water was 9.5. The chosen water chemistry provided higher corrosion rates with an untreated system, which in turn provided a larger window for differentiating between inhibitors.

Simple Cooling Tower Water. This water contained 300 mg/L Ca and 100 mg/L Mg (both as $CaCO_3$), 297 mg/L chloride, 475 mg/L M Alkalinity, 455 mg/L Na, and 10 mg/L calcium carbonate control polymer. The pH of the water was controlled at 8.75-8.85. All inhibitor dosages were 5.0 mg/L active inhibitor.

Complex Cooling Tower Water. The electrolyte test water chosen was one that resembled typical cooling water conditions. This water contained 400 mg/L Ca and 160 mg/L Mg (both as $CaCO_3$), 396 mg/L chloride, 400 mg/L M Alkalinity, 400 mg/L sulfate (as $CaCO_3$), and 383 mg/L Na. A typical water treatment formulation was added to achieve 3 mg/L PBTC, 10 mg/L calcium carbonate control polymer, 7.5 mg/L orthophosphate, and 10 mg/L calcium phosphate control polymer. The pH of the water was 8.95-9.05. Air was bubbled into the system to saturate the water with oxygen.

Pilot System Testing—

Pilot systems provide a more realistic system for evaluation of inhibitors. Each unit is a 25 L non-evaporatory cooling system, with heat exchange rack, corrosion rack, and chilled condenser. The supplied heat flux to the heat exchangers can be adjusted via supplied wattage. The system contains a treatment, hardness, and alkalinity feed along with blow-down capabilities that allows for increasing cycles of concentration. The operating parameters chosen for this testing were a flow velocity of 0.9 m/sec, bulk water temperature of 40° C., and heat flux of 16,000 BTU/ft$^2$/hr. Heat exchange rods were constructed of CDA122 and admiralty brass copper alloys. These heat exchange surfaces were closely monitored, visibly, throughout all testing for signs of both general and localized corrosion. A linear polarization resistance probe, with CDA110 copper electrodes, was used as the method for estimating general corrosion rates on inhibitors throughout all pilot testing. Once a stable corrosion rate was obtained for each untreated solution, the inhibitor was then dosed into the system. As with the corrosion cell testing, two different test waters were used, depending on the stage of testing.

Conceptual Pilot Studies—

Pilot tests were initially performed on a select few candidates to compare their performance against TTA. The water conditions used in testing were the conceptual test water described supra. Using a linear polarization resistance corrater probe, each inhibitor was evaluated for its ability to lower general corrosion rates from around 1.0 mpy to less than 0.2 mpy. For the initial 2.0 mg/L dosage, TTA, di-ethyl CCI, and di-butyl CCI were able to lower corrosion rates to the desired range. After the 10 mg/L dosage, di-methyl CCI and di-propyl CCI were also able to lower corrosion rates to the desired 0.2 mpy or less range. This test served as a preliminary evaluation to confirm that further investigation of the CCI molecules was warranted.

Molecular Modeling Studies—

In order to understand the mechanism of performance for the inhibitors of the present invention, molecular modeling was utilized. Initial screening studies suggested that the contributions to inhibition from steric factors were significant. The molecular modeling studies were designed to confirm this theory by predicting the inhibitor-surface interactions that lead to optimal molecular binding at the copper surface. The studies compared the energy-minimized binding configurations of the inhibitors of the present invention and common commercial inhibitors such as triazoles by considering, e.g., binding sites, geometry and distance of interaction. These configurations were then used to study the lateral interaction between the inhibitor molecules as they approach the metal surface. Using the lowest energy configurations and optimized coverage, total adsorption energy was calculated for each molecule on the metal surface. The copper surface binding energies of these configurations were computed using DMol, a high quality quantum mechanics computer program (available from Accelrys, San Diego, Calif.). These calculations employed an ab initio, local density functional (LDF) method with a double numeric polarization (DNP) basis set and a Becke-Perdew (BP) functional. The two families of modeled species—CCI and triazole—differed in only hydrophobic substituents remote from their binding functionalities. Based on both computational and experimental results, conclusions were drawn regarding the electronic and steric nature of cooper surface binding and corrosion inhibition.

In simple terms, the modeling determined each molecule's most favorable interaction with the metal surface by considering binding sites, geometry and distance. The modeling also considered the lateral interaction between inhibitor molecules as they approached the metal surface. The modeling studies calculated total adsorption energy for each molecule using lowest energy configurations and optimized coverage. The total adsorption energies for substituted versions of BTA were compared to the total adsorption energies of CCIs according to the present invention. Table 1 provides a summary of the total adsorption energy for BTA derivatives and CCIs—

TABLE 1

Total Adsorption Energies for Corrosion Inhibitors

| Inhibitor Molecule at Optimized Coverage | Substituted Group | Total Adsorption Energy (kJ/mole) |
|---|---|---|
| Benzotriazole Derivatives (0.33 mL) | —H(BTA) | −78.0 |
| | —$CH_3$(TTA) | −83.7 |
| | —$CH_2CH_3$ | −76.0 |
| | —$C(CH_3)_2$ | −72.0 |
| | —$C(CH_3)_3$ | −10.0 |
| CCI Derivatives (0.25 mL) | —$CH_3$ | −225.0 |
| | —$CH_2CH_2CH_3$ | −154.0 |

The series of studies modeled the approach of selected inhibitors to a two-layer copper atom cluster of sixteen atoms. Three potential binding sites on the copper were selected: 1) over a top layer copper atom, 2) over a bottom layer copper atom, and 3) over a copper interstitial site. These three sites are illustrated in FIG. 1.

Three angles of approach, or configuration types, for the inhibitor were also selected: Flat where the plane of the molecule is parallel to the copper surface; Up where the molecule is perpendicular to the copper surface with the primary binding functionalities pointing down; and S where the molecule is perpendicular to the copper surface with only one of the binding functionalities pointing down toward the surface. The angles of approach relative to the copper surface are illustrated in FIG. 2. The UP-2 configuration of BTA and TTA refer to a perpendicular orientation with two nitrogen atoms pointing down as illustrated in FIG. 3.

Within each molecular configuration type, multiple variations were possible due to the skewing and twisting of the non-binding substituent groups. However, the modeling program was able to determine the lowest energy configuration within each of the three types of approach and predict the orientation of interaction with the copper surface. Table 2 summarizes the results of the modeling study on four molecules—

TABLE 2

Lowest Energy Configurations and Binding Energies for Corrosion Inhibitors

| Inhibitor Molecule | Configuration Type | Orientation with Copper Surface | Binding Energy (kcal/mole) |
|---|---|---|---|
| BTA | FLAT | Parallel to surface over many sites | 12.7 |
| BTA | UP-2 | Over top copper atoms | 30.2 |
| TTA | UP-2 | Over top copper atoms | ~31 |
| Di-methyl CCI | FLAT | Over interstitial sites | 2.9 |
| Di-methyl CCI | S | Over lower copper atom | 15.2 |
| Di-methyl CCI | UP | slightly skewed over top copper atoms | 18.4 |
| Di-propyl CCI | UP | slightly skewed over top copper atoms | ~19 |

The molecular modeling studies indicate that BTA, TTA, and the new CCI species all exhibit reasonably strong binding energies in generally UP configurations. This spatial orientation allowed the binding functionalities of each molecule best access to the copper surface atoms. At the same time, the UP configurations point out the relatively hydrophobic portions of these molecules toward water. All molecules showed very weak binding energies in the FLAT configuration.

Finally, remote substitution has very little effect on binding energies. Hence, BTA and TTA show very similar binding energies. The same is true for di-methyl CCI and di-propyl CCI. Accordingly, if the electronic aspects of binding are relatively equivalent for molecules within a structural series, then performance differences can be attributed to steric effects. For instance, it is recognized that the enhanced performance of TTA over BTA is due to the greater steric shielding afforded by the methyl group. The differences in the size of hydrophobic groups are even more pronounced for the inhibitor of the present invention.

Using the lowest energy configurations and optimized coverage determined from the configuration studies, another molecular modeling study was performed for evaluating the lateral interaction between the inhibitor molecules as they approach the metal surface. Based on this interaction, total adsorption energy was then calculated for each molecule onto the metal surface. Table 3 summarizes the results of the calculated adsorption energies, in kJ/mole, for BTA, TTA, t-butyl benzotriazole, di-methyl-CCI, and di-propyl-CCI. The more negative the number, then the stronger the attraction.

TABLE 3

Total Adsorption Energies for Corrosion Inhibitors (kJ/mole)

| BTA | TTA | t-Butyl Benzotriazole | Di-methyl CCI | Di-propyl CCI |
|---|---|---|---|---|
| −78 | −83.7 | −10 | −225 | −154 |

From the above molecular modeling studies the following was determined. Firstly, adsorption energies for the CCI inhibitors of the present invention are tremendously stronger than those of the triazole family. This increased attraction indicates that the CCI functionality may offer a much better "hook" for attaching to the metal surface than the triazole functionality. Secondly, the slight improvement in adsorption strength of TTA over BTA may indicate that electron donating groups can enhance adsorption.

Thirdly, the much larger, bulky substituents weaken adsorption energies by slowing the rate of molecular packing onto the metal surface. This weakening is most noticeable for di-propyl CCI and t-butyl benzotriazole. The t-butyl benzotriazole is widely claimed to form a more durable film than TTA, due to its more hydrophobic backbone. However, it is also known that t-butyl benzotriazole takes a longer amount of time to form its film on the metal surface than TTA or BTA. It appears that the weaker adsorbances calculated for the inhibitors with larger substituents may be a better indicator of the time needed for film formation than the actual ability of the film to eventually prevent corrosion.

Finally, the calculations only accounted for the steric hindrance of initial adsorption onto the metal. The benefit from a more hydrophobic backbone on the formed films, from the larger substituents, could not be considered in the calculations.

The molecular modeling studies served as a useful prelude to electrochemical testing. The studies indicate that the CCI functionality offers a drastic improvement over triazoles by providing a better "hook" for attaching the molecule to the metal surface. Further, it appears that even larger, more hydrophobic substituents offer more efficient corrosion inhibitors as long as this group does not become so large as to sterically prevent the film from forming or the inhibitor from remaining water-soluble. By finding the right balance between hydrophobicity and steric hindrance, the "shield" of the inhibitor can be modified to provide the best yellow metal corrosion inhibitor possible.

Inhibitor Performances—Demonstrations of Film Durability and Resistance

Tafel Polarizations with Residual Inhibitor. Initial testing was performed in the primary screening water with 5.0 mg/L residual inhibitor. The working copper electrodes were first placed into the corrosion cell, filled with the cooling tower matrix, and allowed to sit undisturbed for approximately one hour. At that time, a 5.0 mg/L dosage of active inhibitor was added to the water. The electrodes sat undisturbed overnight to allow for complete formation of the protective films and electrode stabilization. The electrodes were then polarized in their existing corrosion cell the following day. The filmed electrodes were then allowed to sit one hour to allow the OCP to stabilize before polarizations were performed. Differences were found in the time required to reach optimum inhibitor performance for the various hydrophobic substituents. The resulting Tafel extrapolated corrosion rates are plotted in FIG. 3.

Referring to FIG. 3 it is seen that di-methyl CCI reached its lowest corrosion rates within a few hours. The larger substituents reached their lowest corrosion rates the following day. TTA provided low corrosion rates immediately and maintained them throughout testing. The corrosion rates for the larger substituents were generally tenfold lower than the smaller substituents by the following day and compared well to the performance of TTA.

Long term tests further indicated that these larger substituents maintained their inhibition properties for an extended period of time, while the smaller groups, such as di-methyl CCI and di-ethyl CCI, began to show signs of breakdown. It is believed that these extended inhibition properties were due to the ability of the larger, more hydrophobic, substituents to form a more protective film on the metal surface that remained more resistant to penetration by electrochemically active species.

Various dosages of active inhibitor were evaluated for di-benzyl CCI by Tafel polarization of admiralty brass electrodes. The plots can be seen in FIG. 4. With increasing dosage the suppression of both the anodic curve ($\beta_a$) and the cathodic curve ($\beta_c$) improved significantly, indicating a greatly improved impedance of both anodic and cathodic corrosion reactions. FIG. 5 provides visible evidence of improved corrosion inhibition with increasing dosage.

When comparing previous Tafel polarizations, it was noted that the inhibitors of the present invention suppress both the anodic and cathodic corrosion reactions overall. This suppression was even more pronounced for the larger substituents tested. The CCI compounds of the present invention also increased the slope of the anodic line ($\beta_a$), indicating further suppression of the anodic currents. This increase was most pronounced for di-benzyl, di-isobutyl, and di-pentyl CCI. These results also indicate that the CCI molecules of the present invention were helpful in suppressing both corrosion reactions. Overall, the various hydrophobic substituents of those compounds seemed to have a greater effect on the suppression of the anodic reaction than the cathodic reaction.

Tafel Polarizations without Residual Inhibitor. This procedure was identical to the test with residual inhibitor. Here, the working copper electrode was allowed to form the inhibitor film overnight in the presence of 5.0 mg/L active inhibitor dosed into the primary screening water. The next day the electrode was removed and rinsed with DI water and placed in a separate corrosion cell, filled with the primary screening water without any residual inhibitor. After one hour, Tafel polarizations were made. This method allowed for the full evaluation of the film only, without any residual inhibitor present for repair.

FIG. 6 shows the Tafel plots of the leading inhibitors, along with tolyltriazole (TTA) and an untreated "blank" solution. The plots indicate a similar suppression of the anodic current between three inhibitors: di-benzyl, di-isobutyl, and di-propyl CCI. However, there was greater separation between the cathodic curves, with di-isobutyl CCI displaying slightly better suppression of the cathodic reaction, followed by di-benzyl CCI and finally di-propyl CCI. The differences in the suppression of the cathodic reactions are believed to primarily be the result of the variations in hydrophobicity of the shielding substituents, i.e., the more hydrophobic the backbone of the film, the more that film can resist penetration and attack from electrochemically active species in the cooling water. All three suppressed both reactions better than TTA, which was shifted much more to the right, closer to the blank (inhibitor free) solution. Tafel extrapolation was performed by the DMol software program described above and was conducted for the graphs in FIG. 6. The resulting corrosion rates in mpy are listed in Table 4—

TABLE 4

Tafel Extrapolated Corrosion Rates from FIG. 7

| Blank | Tolyltriazole | di-propyl CCI | di-isobutyl CCI | di-benzyl CCI |
|---|---|---|---|---|
| 0.89 | 0.34 | 0.02 | 0.03 | 0.01 |

Table 4 shows that without residual inhibitor present to repair damage, the performance of TTA declined dramatically while the CCI films of the present invention continue to impede corrosion very well.

Cyclic Polarizations with Residual Inhibitor. Initial testing was performed in the primary screening water with 5.0 mg/L residual inhibitor. The working copper electrodes were first placed into the corrosion cell, filled with the cooling tower matrix, and allowed to sit undisturbed for approximately one hour. At that time, a 5.0 mg/L dosage of active inhibitor was added to the water. Inhibitors chosen for evaluation were di-benzyl CCI, BTA and TTA. The electrodes sat undisturbed overnight to allow for complete formation of the protective films and electrode stabilization. The electrodes were then polarized in their existing corrosion cell the following day. The filmed electrodes were then allowed to sit one hour to allow the OCP to stabilize before polarizations were performed.

The resulting cyclic polarization graphs with residual inhibitor present can be seen in FIG. 7. All inhibitors show more suppression in current density than an untreated solution, indicating a much more noticeable $E_{bd}$ around 200 mV. The cyclic polarization plot of the CCI treated electrode indicated a film stability comparable to the triazoles, falling somewhere between the performance of BTA and TTA. The CCI film maintained lower anodic current densities than BTA in its passive region, along with a comparable passive range (between OCP and the breakdown potential ($E_{bd}$)) to both triazoles. These results indicate that the CCI molecule provides a film whose protection is comparable to the triazole molecules when both have residual inhibitor present to repair damaged film. However, when no residual inhibitor is present, the CCI molecule's film clearly differentiates itself as a superior barrier to protect against corrosion when compared to the triazole films.

Cyclic Polarizations without Residual Inhibitor. Working copper electrodes were first placed into the corrosion cell, filled with the cooling tower matrix, and allowed to sit undisturbed for approximately one hour. At that time, a 5.0 mg/L dosage of active inhibitor was added to the water. Like the Tafel polarization test above, the electrodes sat undisturbed overnight to allow for complete formation of the protective films and electrode stabilization. The electrodes were removed from their existing corrosion cells the following day, rinsed with DI water, and placed in a separate corrosion cell that was filled with the cooling tower water matrix, without residual inhibitor. The filmed electrodes were then allowed to sit one hour to allow the OCP to stabilize before polarizations were performed.

The resulting cyclic polarization graphs with residual inhibitor present can be seen in FIG. 8. A noticeable shift to higher current densities can be seen with the TTA and BTA curves along with a much more noticeable $E_{bd}$ around 200 mV. Both triazole curves mirror the curve of the untreated solution, indicating that neither film was able to offer any measurable protection against corrosion. In contrast, di-benzyl CCI displayed much lower current densities throughout its anodic scan with no noticeable decrease in its $E_{bd}$. These findings indicate that the CCI molecule forms a much more durable film than triazoles and may not need residual inhibitor continuously present to protect against both general and localized corrosion.

Pilot Testing Evaluations—

Without Residual Inhibitor and with Low Levels of Hypochlorite. Pilot testing was conducted with the simple cooling tower water, using linear polarization resistance corrosion measurements. These tests were performed to determine if indications of film durability could be translated to more realistic pilot systems treated with low levels of hypochlorite. In these tests, inhibitors were allowed to form protective films with a 5 mg/L active dosage for 16 hours. After forming the film, the inhibitor was flushed from the system and a 0.5 mg/L free chlorine feed was introduced.

The resulting corrosion rates from two tests are plotted in FIG. 9 against measured free chlorine. The results indicated that the TTA film began to break down once free chlorine levels reached around 0.1 mg/L, allowing corrosion rates to reach 0.5 mpy. In contrast, the di-benzyl CCI film produced using the compound according to the present invention maintained much lower corrosion rates with higher levels of free chlorine. The corrosion rates for the di-benzyl CCI films did not begin to significantly increase until free chlorine concentrations reached 0.2-0.3 mg/L. Even at this point, the rate of increase was much slower than compared to the TTA film. Corrosion rates did not typically reach unacceptable levels of around 0.2 mpy, until the free chlorine concentrations climbed above 0.4 mg/L.

Once the free chlorine levels reached over 0.5 mg/L, the hypochlorite feeds were stopped to allow free chlorine levels to degrade to less than 0.1 mg/L. The purpose of this was to determine if corrosion rates would drop back to the levels prior to hypochlorite addition, which would indicate the remaining intactness of the protective film. The TTA film continued to maintain an unacceptable corrosion rate of 0.4 mpy with less than 0.1 mg/L free chlorine. This indicated potential breakdown of the film instead of penetration attack. The CCI film's corrosion rates dropped to 0.1 mpy with less than 0.1 mg/L free chlorine, indicating that the film produced using the CCI composition according to the present invention remained more intact.

These results indicate that the CCI molecules of the present invention can offer more corrosion protection in systems where a continuous chlorine feed is in operation, as these levels are generally around 0.2 mg/L free chlorine. In order to explore this possibility further, TTA and di-propyl CCI films were evaluated by Tafel polarizations in primary screening water with no residual inhibitor and 0.2-0.4 mg/L free chlorine. These results proved to be even more dramatic, indicating a much greater susceptibility to breakdown of the film formed with TTA than with di-propyl CCI according to the present invention.

FIG. 10 depicts the resulting corrosion rates over time as measured by Tafel extrapolation. As seen from the extrapolations, all of the CCI inhibitors of the present invention performed approximately tenfold better than TTA. The extrapolations illustrate that TTA cannot sustain a protective barrier by itself and must rely on its residual inhibitor to repair damaged film. In contrast, the CCI inhibitors of the present invention provide films that maintain corrosion protection without the added residual inhibitor. FIG. 11 further supports this. FIG. 11 shows pictures of the electrodes after testing. As seen in FIG. 11, severe localized corrosion occurred on the TTA filmed electrode, while the di-propyl CCI filmed electrode remained undamaged.

Pilot Testing via Slug Dosing without Maintained Residual Inhibitor. Evaluations were conducted to determine if the film would protect against attack from a continuously maintained 0.2-0.3 mg/L hypochlorite concentration over a longer period of time. Di-benzyl CCI and TTA films were evaluated for four weeks with no residual inhibitor present in the cooling water. An untreated system was also evaluated for comparison. Copper alloy CDA-122 rods and admiralty brass CDA-443 heat exchange tubes were added to the pilot systems for visual observations throughout the duration of the test. LPR probes with copper alloy CDA-110 electrodes were used to continuously monitor general corrosion rates.

All testing was performed in the complex cooling water with an initial slug dose of 5.0 mg/L residual inhibitor. The systems were then flushed to remove the residual inhibitor. To make the water more aggressive to the films, a 0.20 mg/L free chlorine feed was started on the twelfth day of testing. A plot of free chlorine concentrations throughout the test is shown in FIG. 12. The free chlorine concentrations were carried up to approximately 0.15 mg/L within four days and then slowly increased to 0.20 mg/L by the end of the test. The LPR probes were unable to detect corrosion rates until the free chlorine feed was started. At this time, the corrosion rates began to increase for both the untreated and TTA treated systems. These rates throughout testing can be seen in FIG. 13. FIG. 13 shows that the TTA treated system reached a higher corrosion rate of 0.30 mpy more quickly than the untreated system. The di-benzyl CCI treated system maintained lower corrosion rates throughout testing, never reaching higher than 0.10 mpy. The differences in corrosion rates were further supported by ICP analysis of the cooling water for soluble copper concentrations. These concentrations can be seen in FIG. 14. From FIG. 14 it is seen that the di-benzyl CCI treated system maintained lower soluble copper concentrations throughout testing, indicating that its more impeded copper corrosion reactions were resulting in less soluble copper in the cooling water.

Visual observations made of the heat exchange tubes throughout testing were even more dramatic than measured corrosion rates. Both untreated and TTA treated systems began to show visible signs of corrosion on both the admiralty brass and CDA-122 heat exchangers once the free chlorine concentrations reached 0.10 mg/L. These signs of corrosion began as spotty discoloration of the metal surfaces and gradually became more widespread, resulting in a complete discoloration of the metal surface from the original copper metal surface to a completely grey surface. Photographs of the three heat exchange tubes were taken after the test and can be seen in FIG. 15. The di-benzyl CCI treated system never developed any corrosion deposition or discoloration on the metal surface. The heat exchangers continued to look the same as the day they were installed into the system.

Performance at Protecting Against Mild Steel Corrosion. The above described test was repeated using C1010 electrodes to monitor the general corrosion rates of mild steel (carbon and low alloy steel) for two pilot systems treated with di-benzyl and di-propyl CCI, as well as an untreated pilot system. The results seen in FIG. 16 indicated that the CCI molecule of the present invention also offers some protection of mild steel. FIG. 16 illustrates that while the corrosion rates of the untreated solution climbed to above 11.0 mpy, both the CCI molecules were able to maintain much lower corrosion rates of around 3.1 mpy. This performance is an indication that the CCI molecule of the present invention offers further protection of mild steel surfaces within a cooling system, an added benefit when treating copper alloy surfaces with the inhibitor.

Performance at Protecting Against Cast Iron Corrosion. The above described test is repeated using cast iron electrodes to monitor general corrosion rates of cast iron for two pilot systems treated with di-benzyl and di-propyl CCI, as well as an untreated pilot system. The results demonstrate that the CCI molecules maintain lower corrosion rates than an untreated solution. This performance indicates that the CCI molecules of the present invention offer further protection of cast iron surfaces within a cooling system, an added benefit when treating copper alloy surfaces with the inhibitor.

Performance at Protecting Against Stainless Steel Corrosion. The above described test is repeated using stainless steel electrodes to monitor general corrosion rates of stainless steel for two pilot systems treated with di-benzyl and di-propyl CCI, as well as an untreated pilot system. The results demonstrate that the CCI molecules maintain lower corrosion rates than an untreated solution. This performance indicates that the CCI molecules of the present invention offer further protection of stainless steel surfaces within a cooling system, an added benefit when treating copper alloy surfaces with the inhibitor.

Performance at Protecting Against Galvanized Steel Corrosion. The above described test was repeated using galvanized steel electrodes to monitor general corrosion rates of galvanized steel for two pilot systems treated with di-benzyl and di-propyl CCI, as well as an untreated pilot system. The results demonstrate that the CCI molecules maintain lower corrosion rates than an untreated solution. This performance indicates that the CCI molecule of the present invention offers further protection of galvanized steel surfaces within a cooling system, an added benefit when treating copper alloy surfaces with the inhibitor.

Performance at Protecting Against Nickel Corrosion. The above described test was repeated using nickel electrodes to monitor general corrosion rates of nickel for two pilot systems treated with di-benzyl and di-propyl CCI, as well as an untreated pilot system. The results demonstrate that the CCI molecules maintain lower corrosion rates than an untreated solution. This performance indicates that the CCI molecules of the present invention offer further protection of nickel surfaces within a cooling system, an added benefit when treating copper alloy surfaces with the inhibitor.

From the above studies it is seen that TTA forms a very unstable film. TTA has the ability to quickly repair its film when damaged; however, the survival of the TTA film relies completely on the presence of residual inhibitor for repair. With no residual inhibitor present, the TTA film fails.

In contrast to the triazole molecules, the CCI compounds of the present invention form a durable film on metal surfaces, particularly yellow metal surfaces. These CCI molecules tend to be slower than the triazoles in film formation, which is believed due to their more bulky substituents. However, these more bulky CCI substituents provided a more hydrophobic barrier for corrosion protection than the triazole films. Further, films formed from the CCI molecules protected against low level hypochlorite attack over the range of about 0.2 to about 0.4 mg/L free chlorine. Unlike the triazole films, films formed from the CCI molecules do not require an ever-present residual inhibitor in order to provide effective corrosion protection.

EXAMPLES

Example 1

Preparation of Sodium Dimethyl Dithiocarbamate as an Aqueous Solution

A clean, dry, four-neck 500 mL flask was charged with 59.6 g of city water, 39.0 g (0.52 mol) of 60% aqueous dimethyl amine, and a large stir bar. Stirring was initiated and the flask was fitted with a condenser, thermocouple, and heating mantle. A 25 mL addition funnel was charged with 38.0 g (0.50 mol) of carbon disulfide and attached to the reaction flask. A 50 mL addition funnel was charged with 40.0 g (0.50 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for thirty minutes at 40° C., after which the sodium dimethyl dithiocarbamate solution was a clear yellow-green solution. The pH was 12.0-14.0 and the activity was 40-41% by acid decomposition analysis.

Example 2

Preparation of Sodium Diethyl Dithiocarbamate as an Aqueous Solution

A clean, dry, four-neck 500 mL flask was charged with 113 g of city water, 19.0 g (0.26 mol) diethyl amine, and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium diethyl dithiocarbamate solution was a clear yellow-green solution. The pH was 12.0-14.0 and the activity was 24-26% by acid decomposition analysis.

Example 3

Preparation of Sodium Dipropyl Dithiocarbamate as an Aqueous Solution

A clean, dry, four-neck 500 mL flask was charged with 189 g of city water, 36.9 g (0.365 mol) dipropyl amine (Aldrich, 99%), and a large stir bar. Stirring was initiated and the flask was fitted with a condenser, thermocouple, and heating mantle. A 25 mL addition funnel was charged with 26.6 g (0.35 mol) of carbon disulfide and attached to the reaction flask. A 50 mL addition funnel was charged with 28.0 g (0.35 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium dipropyl dithiocarbamate solution was a deep yellow clear solution. The pH was 12.0-14.0 and the activity was 24-26% by acid decomposition.

Example 4

Preparation of Sodium Diisopropyl Dithiocarbamate as a Solution in Methanol/Water Co-solvents A clean, dry, four-neck 500 mL flask was charged with 133.4 g of city water, 50.0 g methanol, 26.3 g (0.26 mol) diisopropyl amine (Aldrich), and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium diisopropyl dithiocarbamate solution was a bright yellow clear solution. The pH was 12.0-14.0 and the activity was 19-21% by calculation.

Example 5

Preparation of Sodium Dibutyl Dithiocarbamate as an Aqueous Solution

A clean, dry, four-neck 500 mL flask was charged with 154.5 g of city water, 33.5 g (0.26 mol) dibutyl amine (Aldrich), and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium dibutyl dithiocarbamate solution was a pale yellow clear solution. The pH was 12.0-14.0 and the activity was 24-26% by calculation.

Example 6

Preparation of Sodium Diisobutyl Dithiocarbamate as an Aqueous Solution

A clean, dry, four-neck 500 mL flask was charged with 73.0 g of city water, 16.0 g (0.124 mol) diisobutyl amine (Aldrich), and a large stir bar. Stirring was initiated and the flask was fitted with a condenser, thermocouple, and heating mantle. A 25 mL addition funnel was charged with 9.0 g (0.118 mol) of carbon disulfide and attached to the reaction flask. A 50 mL addition funnel was charged with 9.5 g (0.118 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately thirty minutes. The reaction was then allowed to cook for one hour at 40° C., after which the sodium diisobutyl dithiocarbamate solution was a pale yellow clear solution. The pH was 12.0-14.0 and the activity was 24-26% by acid decomposition.

Example 7

Preparation of Sodium Dipentyl Dithiocarbamate as an Aqueous Solution

A clean, dry, four-neck 500 mL flask was charged with 175.0 g of city water, 40.8 g (0.26 mol) dipentyl amine (Aldrich), and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium dipentyl dithiocarbamate product was a yellow clear solution. The pH was 12.0-14.0 and the activity was 24-26% by calculation.

Example 8

Preparation of Sodium Dibenzyl Dithiocarbamate as a Solution in IPA/Water Co-Solvents A clean, dry, four-neck 500 mL flask was charged with 176.0 g of city water, 29.0 g of isopropyl alcohol, 51.2 g (0.26 mol) dibenzyl amine (Aldrich), and a large stir bar. Stirring was initiated and the flask was fitted with a condenser, thermocouple, and heating mantle. The reaction is an opaque colorless suspension at this point. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium dibenzyl dithiocarbamate solution was a dark yellow clear solution. The pH was 12.0-14.0 and the activity was 24-26% by calculation.

Example 9

Preparation of Sodium 4-(3-Aminopropyl)Morpholine Dithiocarbamate as an Aqueous Solution A clean, dry, four-neck 500 mL flask was charged with 130.0 g of city water, 37.4 g (0.26 mol) 4-(3-aminopropyl) morpholine (Aldrich), and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately forty-five minutes. The reaction was then allowed to cook for one hour at 40° C., after which the 4-(3-aminopropyl)morpholine dithiocarbamate solution was a clear orange solution. The pH was 12.0-14.0 and the activity was 28-30% by calculation.

Example 10

Preparation of Sodium Morpholine Dithiocarbamate as an Aqueous Solution

A clean, dry, four-neck 500 mL flask was charged with 93.0 g of city water, 22.6 g (0.26 mol) morpholine (99%, Aldrich), and a large stir bar. Stirring was initiated and the flask was fitted with a condenser, thermocouple, and heating mantle. A 25 mL addition funnel was charged with 19.0 g (0.25 mol) of carbon disulfide and attached to the reaction flask. A 50 mL addition funnel was charged with 20.0 g (0.25 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately thirty minutes. The reaction was then allowed to cook for one hour at 40° C., after which the sodium morpholine dithiocarbamate solution was a clear yellow-green solution. The pH was 12.0-14.0 and the activity was 28-30% by calculation.

Example 11

Preparation of Disodium Isophorone-Bis-Dithiocarbamate as an Aqueous Solution

A clean, dry, four-neck 500 mL flask was charged with 189.0 g of city water, 44.3 g (0.26 mol) isophorone diamine, and a large stir bar. Stirring was initiated and the flask was fitted with a condenser, thermocouple, and heating mantle. A 25 mL addition funnel was charged with 38.0 g (0.50 mol) of carbon disulfide and attached to the reaction flask. A 50 mL addition funnel was charged with 40.0 g (0.50 mol) of 50% sodium hydroxide and attached to the reaction flask. The reaction was then heated to 30° C. with stirring.

When the reactor contents had reached 30° C., the carbon disulfide feed was started at a slow drop-wise rate. After five minutes the sodium hydroxide feed was also started at a slow drop-wise rate. The feeds were regulated such that the reaction temperature did not exceed 45° C., and both additions were complete after approximately one hour. The reaction was then allowed to cook for one hour at 40° C., after which the sodium diethyl dithiocarbamate solution was a clear orange solution. The pH was 12.0-14.0 and the activity was 24-26% by acid decomposition analysis.

An effective amount of an organic co-solvent for maintaining the solubility of the compounds or molecules can also be added during the synthesis of CCI inhibitors according to the present invention. For example, based on percent co-solvent per weight of active inhibitor, the amount of co-solvent can range from 1-100%. In one aspect, the co-solvent amount ranges from about 20 to about 60%. In another aspect, the co-solvent amount ranges from about 35 to about 45%.

As an example, in a formulation or product containing 25% active (the above described compounds or molecules), the co-solvent can be present in the product in an amount of from about 1 to about 50% per weight of active inhibitor. As a further example, consider a product having 25% dibenzyl dithiocarbamate as the active inhibitor. 10% by weight of the product of a co-solvent such as an alcohol or hydroxylamine, e.g., isopropyl alcohol and/or diethyl hydroxylamine, can be added, equating to 40% of the active component weight. Accordingly, the inhibition method described supra also includes dosing an aqueous system with an effective amount as described above of a co-solvent and active inhibitor formulation.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A method of inhibiting yellow metal corrosion comprising adding to an aqueous system an aqueous solution comprising an effective amount of a yellow metal corrosion inhibitor, said yellow metal corrosion inhibitor comprising the structure

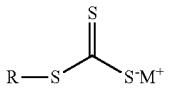

where $M^+$ is an alkali or alkaline earth metal cation, and R is H, $C_1$-$C_{12}$ alkyl, aryl or polyaryl, $C_1$-$C_{12}$ alkaryl, $C_1$-$C_{12}$ cycloalkly, $C_1$-$C_{12}$ alkoxy, $C_1$-$C_{12}$ polyalkoxy, hydroxyl or polyhydroxy, $C_1$-$C_{12}$ alkylcarboxy, $C_1$-$C_{12}$ alkylamino, $C_1$-$C_{12}$ haloalkyl, haloaryl, alkoxyaryl, hydroxyaryl, aminoaryl, carboxyaryl, and combinations or further functionalized variants of the above;

adding to the aqueous system an effective amount of isopropyl alcohol to maintain the solubility of the corrosion inhibitor; and associating said yellow metal corrosion inhibitor with a yellow metal.

2. The method of inhibiting yellow metal corrosion according to claim 1 further comprising detecting said corrosion inhibitor in said aqueous system by UV spectroscopy and/or oxidation-reduction potential measurement, measuring the amount of said corrosion inhibitor by UV spectroscopy and/or oxidation-reduction potential measurement, and controlling the dosage of said corrosion inhibitor based on the measured amount.

3. The method according to claim 2 further comprising: detecting other additives by UV spectroscopy, measuring the amount based on UV spectroscopy of those other additives, and controlling the dosage of those other additives based on the measured amount.

4. The method according to claim 3 wherein the other additives comprise polymers having aromatic constituents.

5. The method according to claim 1 wherein said aqueous solution comprising one or more salts of said corrosion inhibitor.

6. The method of according to claim 5 wherein the aqueous solution is about 10% to about 50% active.

7. The method according to claim 5 wherein the aqueous solution has a pH able to stabilize the one or more salts in the solution.

8. The method according to claim 7 wherein the aqueous solution has a pH of at least about 10 or greater.

9. The method according to claim 8 wherein the aqueous solution has a pH of from about 11 to about 13.

10. The method according to claim 1 wherein said yellow metal is copper.

11. The method according to claim 1 wherein said yellow metal is an alloy of copper.

12. The method according to claim 1 wherein said aqueous system is a water treatment system.

13. The method according to claim 1 wherein said yellow metal further comprises a heat exchanger surface.

14. A method of inhibiting yellow metal corrosion comprising adding to an aqueous system an aqueous solution comprising an effective amount of a yellow metal corrosion inhibitor, said yellow metal corrosion inhibitor comprising the structure

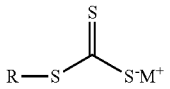

where $M^+$ is an alkali or alkaline earth metal cation, and R is H, $C_1$-$C_{12}$ alkyl, aryl or polyaryl, $C_1$-$C_{12}$ alkaryl, $C_1$-$C_{12}$ cycloalkly, $C_1$-$C_{12}$ alkoxy, $C_1$-$C_{12}$ polyalkoxy, hydroxyl or polyhydroxy, $C_1$-$C_{12}$ alkylcarboxy, $C_1$-$C_{12}$ alkylamino, $C_1$-$C_{12}$ haloalkyl, haloaryl, alkoxyaryl, hydroxyaryl, aminoaryl, carboxyaryl, and combinations or further functionalized variants of the above; and associating said yellow metal corrosion inhibitor with a yellow metal, wherein said yellow metal further comprises a heat exchanger surface.

15. The method of claim 14 further comprising adding to the aqueous system an effective amount of an organic co-solvent that is able to maintain the solubility of the corrosion inhibitor.

16. The method of inhibiting yellow metal corrosion according to claim 14 further comprising detecting said corrosion inhibitor in said aqueous system by UV spectroscopy and/or oxidation-reduction potential measurement, measuring the amount of said corrosion inhibitor by UV spectroscopy and/or oxidation-reduction potential measurement, and controlling the dosage of said corrosion inhibitor based on the measured amount.

17. The method according to claim 16 further comprising: detecting other additives by UV spectroscopy, measuring the amount based on UV spectroscopy of those other additives, and controlling the dosage of those other additives based on the measured amount.

18. The method according to claim 17 wherein the other additives comprise polymers having aromatic constituents.

19. The method according to claim 14 wherein said aqueous solution comprising one or more salts of said corrosion inhibitor.

20. The method of according to claim 19 wherein the aqueous solution is about 10% to about 50% active.

21. The method according to claim 19 wherein the aqueous solution has a pH able to stabilize the one or more salts in the solution.

22. The method according to claim 21 wherein the aqueous solution has a pH of at least about 10 or greater.

23. The method according to claim 22 wherein the aqueous solution has a pH of from about 11 to about 13.

24. The method according to claim 14 wherein said yellow metal is copper.

25. The method according to claim 14 wherein said yellow metal is an alloy of copper.

26. The method according to claim 14 wherein said aqueous system is a water treatment system.

* * * * *